US009863127B2

(12) United States Patent
Balkau et al.

(10) Patent No.: US 9,863,127 B2
(45) Date of Patent: Jan. 9, 2018

(54) SANITARY FITTING

(71) Applicant: HANSGROHE SE, Schiltach (DE)

(72) Inventors: Matthias Balkau, Schiltach (DE); Joachim Blattner, Haslach (DE); Ulrich Kinle, Schenkenzell (DE); Marcus Wöhrle, Schiltach (DE)

(73) Assignee: Hansgrohe SE, Schiltach (DE)

( * ) Notice: Subject to any disclaimer, the term of this patent is extended or adjusted under 35 U.S.C. 154(b) by 0 days.

(21) Appl. No.: 13/777,122

(22) Filed: Feb. 26, 2013

(65) Prior Publication Data

US 2013/0221131 A1 Aug. 29, 2013

(30) Foreign Application Priority Data

Feb. 28, 2012 (DE) ..... 10 2012 203 016

(51) Int. Cl.
*E03C 1/04* (2006.01)
*E03C 1/02* (2006.01)
*E03C 1/086* (2006.01)

(52) U.S. Cl.
CPC ..... *E03C 1/0408* (2013.01); *E03C 1/023* (2013.01); *E03C 1/0405* (2013.01);
(Continued)

(58) Field of Classification Search
CPC B05B 1/30; B05B 1/3026; B05B 1/12; B05B 1/1627; B05B 1/1645;
(Continued)

(56) References Cited

U.S. PATENT DOCUMENTS 3,786,995 A * 1/1974 Manoogian ..... E03C 1/084 239/428.5
4,161,191 A 7/1979 Ranger et al.
(Continued)

FOREIGN PATENT DOCUMENTS

DE 942440 C 5/1956
DE 20300448 U1 4/2003
(Continued)

OTHER PUBLICATIONS

Official Action dated May 31, 2013 in EP 13156396.7.
(Continued)

*Primary Examiner* — Arthur O Hall
*Assistant Examiner* — Christopher R Dandridge
(74) *Attorney, Agent, or Firm* — Duane Morris LLP

(57) ABSTRACT

A sanitary fitting having an outlet contains an outlet end which is formed in a substantially tubular manner. In this tubular end there is arranged a shut-off valve having a cartridge, water flowing through the center of said shut-off valve. A rotary shaft serves to rotate and thus actuate the valve cartridge. The rotary shaft is arranged and mounted inside a mounting sleeve which contains an outlet element at its outlet-side end. An external sleeve, which forms a flush continuation of the fitting housing, serves to rotate the rotary shaft. The sleeve is connected to the rotary shaft by a radial pin which engages through an arcuate slot that extends in the circumferential direction. When the sleeve is rotated, the position and setting of the outlet element remains the same.

11 Claims, 3 Drawing Sheets

(52) U.S. Cl.
CPC ..... *E03C 1/0412* (2013.01); *E03C 1/086* (2013.01); *Y10T 137/87788* (2015.04)

(58) Field of Classification Search
CPC ..... B05B 1/1654; B05B 1/1636; B05B 1/32; B05B 1/14; B05B 1/18; B05B 1/185; B05B 1/02; B05B 1/26; B05B 1/16; B05B 7/061; A01G 25/162; E03C 1/0408; E03C 1/023; E03C 1/0405; E03C 1/0412; E03C 1/086; E03C 1/08; E03C 1/084
USPC ..... 239/581.1, 581.2, 582.1, 443, 444–449, 239/587.1–587.5, 282, 283
See application file for complete search history.

(56) References Cited

U.S. PATENT DOCUMENTS

| | | | | |
|---|---|---|---|---|
| 4,889,157 | A | 12/1989 | Bergmann | |
| 6,565,018 | B1 * | 5/2003 | Degeyter | 239/581.1 |
| 6,618,872 | B1 * | 9/2003 | Fan | 4/615 |
| 6,962,298 | B1 * | 11/2005 | Martin | 239/447 |
| 7,100,845 | B1 * | 9/2006 | Hsieh | 239/447 |
| 7,322,535 | B2 * | 1/2008 | Erdely | 239/581.1 |
| 7,766,260 | B2 * | 8/2010 | Lin | 239/449 |
| 7,775,462 | B2 * | 8/2010 | Herring et al. | 239/414 |
| 8,028,935 | B2 * | 10/2011 | Leber | 239/436 |
| 2002/0148516 | A1 * | 10/2002 | Bartkus | F16K 11/0743 137/625.46 |
| 2003/0196712 | A1 | 10/2003 | Graber | |
| 2005/0126643 | A1 | 6/2005 | Romero | |
| 2008/0210777 | A1 * | 9/2008 | Lacher | E03C 1/08 239/140 |
| 2008/0272203 | A1 | 11/2008 | Leber | |
| 2009/0090414 | A1 * | 4/2009 | Di Nunzio | 137/1 |
| 2009/0277521 | A1 * | 11/2009 | Weis | E03C 1/08 137/825 |
| 2010/0084487 | A1 * | 4/2010 | Gautschi | B05B 1/083 239/97 |

FOREIGN PATENT DOCUMENTS

| | | | | |
|---|---|---|---|---|
| DE | 203 15 687 | U1 | 2/2004 | |
| DE | 20315687 | * | 3/2004 | E03C 1/04 |
| DE | 20315687 | U1 | 3/2004 | |
| DE | 202004019664 | A1 | 6/2005 | |
| FR | 2330933 | A1 | 6/1977 | |
| RU | 2275538 | C2 | 4/2006 | |
| TW | 372038 | | 10/1999 | |
| TW | M301965 | U | 12/2006 | |
| WO | 2004/051126 | A1 | 6/2004 | |
| WO | 2004051126 | A1 | 6/2004 | |
| WO | WO2004051126 | * | 6/2004 | F16K 27/04 |

OTHER PUBLICATIONS

Office Action issued for corresponding German Patent Application No. 102012203016.6, dated Nov. 21, 2014, 10 pages.
Office Action and Search Report issued in connection with corresponding Taiwanese patent application No. 102107096, dated Jun. 25, 2015, 5 pages.
Official Action in CN application 201310063601.2, dated Mar. 11, 2016.
Official Action dated Nov. 2, 2016 in EPO application 13 156 396.7.
RUSPAT decision to grant dated Jun. 18, 2015.

* cited by examiner

SANITARY FITTING

The invention relates to a sanitary fitting having an outlet.

Sanitary fittings having a rotatable spout as outlet are known, wherein the rotation of the spout is intended to change the jet direction.

Likewise known are jet regulators having a ball joint for changing the jet direction.

Also known are valves which are opened and closed by rotation at the outlet spout. Such valves are known as tap valves. However, in this case, the water-carrying outlet spout is itself rotated.

A sanitary fitting is already known which is arranged on a horizontal surface and formed to extend therefrom as a firstly slightly bent tube which in a top portion forms a U-shaped arc. Shortly above the base surface a sleeve element is rotatably formed as part of the tube, said rotation actuating a valve (US 2005/0126643 A1).

There is further known a supplemental element to be mounted at the outlet of a sanitary fitting, said supplemental element having two outlet alternatives, where it is possible to switch between them using a valve. An outer housing of this supplemental device is used for the switching in that it can be rotated. One of the two outlets extends far out of the housing (U.S. Pat. No. 3,786,995).

Also known is a fitting having a fitting housing at which an outlet is mounted with the use of an adapter. Between the fitting housing and the outlet a rotatable sleeve is arranged at the adapter, where said sleeve can rotate and thus actuate a cartridge arranged in the adapter (EP 1 355 094 A1).

The invention is based on the object of creating a sanitary fitting in which the flow through the outlet can be blocked and opened at the outlet itself.

In order to achieve this object, the invention proposes a sanitary fitting having the features mentioned in claim 1. Developments of the invention are the subject matter of dependent claims.

Whereas, in the case of the sanitary fittings of the prior art having an outlet fitted directly on the fitting, the water-carrying outlet element itself had to be acted upon in order to open and close the outlet, it is now provided according to the invention for a rotatable sleeve surrounding the outlet element to be provided in the region of the outlet, said rotatable sleeve serving as an actuating element at least for a shut-off valve arranged in the sanitary fitting.

In this way, actuation of the shut-off valve does not have an effect on the outlet element.

By way of the actuating element in the form of a sleeve, the shut-off valve can be opened and closed.

According to the invention, the sanitary fitting comprises a sleeve element firmly connected to it in which the outlet element is arranged, e.g. by being pivotably fixed in it. The sleeve forming the actuating element is arranged outside this sleeve element.

According to the invention, it may be provided in one development for a switch-over valve also to be arranged downstream of the shut-off valve in the direction of flow. With the aid of said switch-over valve, for example a more or less large region of the jet-outlet element can be supplied with water. In order to actuate this switch-over valve, a separate actuating element can be provided.

In a further development of the invention, it may be provided for the switch-over valve to be actuated by way of the actuating element, which is also responsible for the shut-off valve. For example, starting from the closed position, the shut-off valve can be opened over a first angle, and the switch-over valve can be actuated following further rotation.

According to the invention, it may be provided according to a further feature of the invention for the outlet out of the housing to have two outlet means, which effect for example different types of jet or different jet patterns. In this case, the switch-over valve can switch over between these two types of jet after the shut-off valve has been opened.

According to the invention, in a development, the shut-off valve may be a straight-way valve, in the case of which the water guide leads directly through the valve.

In a further development of the invention, it may be provided for the outlet element to be mounted in a pivotable and/or rotatable manner in the fitting housing. On account of the independent mounting of the actuating element in the form of a sleeve, when the shut-off valve and/or the switch-over valve is actuated, the previously set direction of the outlet element remains unchanged.

According to the invention, it may be provided for the second jet-outlet means already mentioned at the beginning to have openings which surround the jet-outlet element.

In a development, it may be provided for the fitting housing to be formed in a tubular manner at least in the region of its outlet, wherein the outlet element is arranged on the end side.

According to the invention, it may be provided for the shut-off valve to be in the form of a valve cartridge which is arranged preferably concentrically in the tubular part of the fitting housing in the region of the outlet.

Further features, details and advantages of the invention will become apparent from the claims and the abstract, the wording of both of which is incorporated into the content of the description by reference, from the following description of preferred embodiments of the invention and by way of the drawing, in which:

Figure 1:
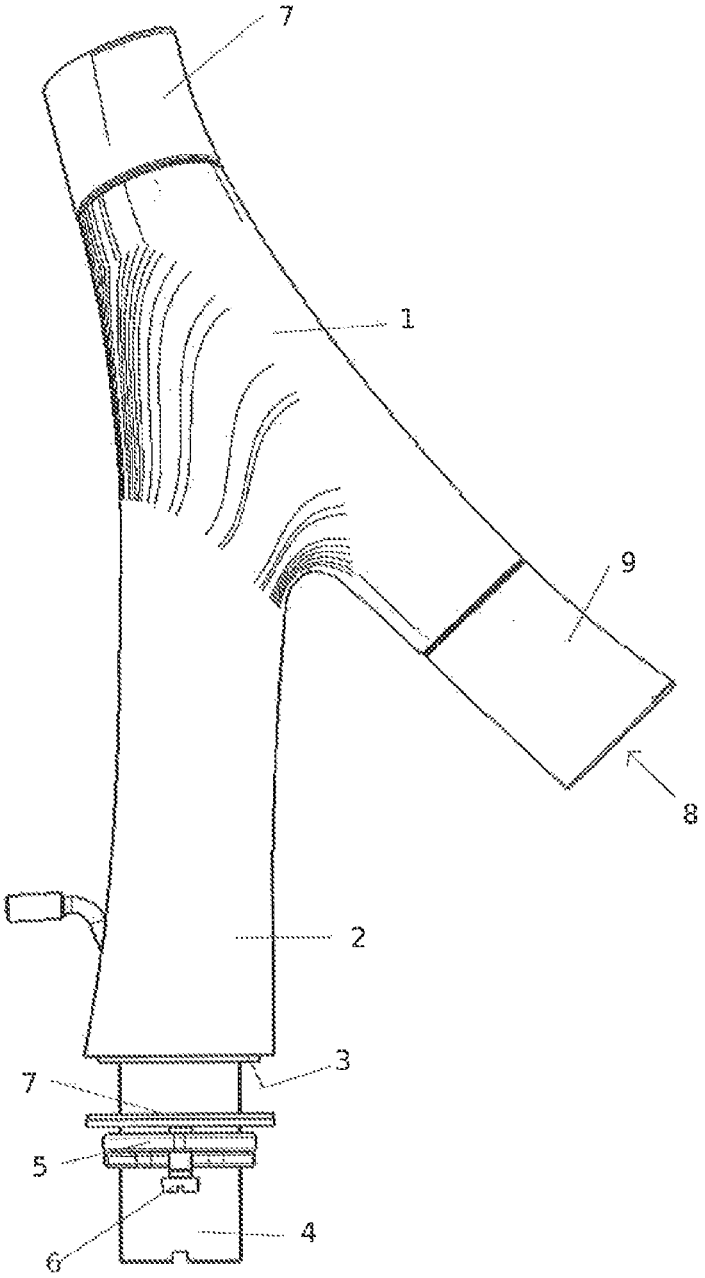
FIG. 1 shows a view of a sanitary fitting according to the invention.

FIG. 1 shows a view of a sanitary fitting having a fitting housing 1. The fitting housing 1 contains a vertical pipe 2, from the underside 3 of which a threaded sleeve 4 projects. The threaded sleeve 4 has a smaller diameter than the bottom end 3 of the vertical pipe 2. The threaded sleeve 4 is provided with an external thread. Screwed onto the latter is a nut 5, which serves to fix the sanitary fitting in a through-opening in a panel. Screwed into the nut 5 are two screws 6, which act on a pressure plate 7. For the purpose of fastening, the threaded sleeve 4 is fitted through the mentioned hole, the pressure plate 7 is threaded on from below, and the nut 5 is screwed in. For final tightening, the screws 6 are tightened.

At the top end of the housing 1 of the sanitary fitting there is arranged an actuating element 7 in the form of a rotary cap which is used to actuate a mixing valve by way of which for example the temperature of the water exiting the sanitary fitting is fixed.

Formed at the bottom end, remote from the rotary cap 7, of the fitting housing is an outlet 8 10 which is surrounded by a sleeve 9. The sleeve 9 extends flush or approximately flush with the fitting housing 1, which is formed in a tubular manner in the region immediately adjoining the sleeve 9. Water flows out of the end side of the outlet 8 with the valve open.

The following figures are now limited to details of the fitting housing 1 in the region of the outlet. In this region, the fitting housing 1 is formed in an approximately tubular manner, and the rotary sleeve 9 represents a continuation of the external form of the fitting housing 1.

Arranged in the fitting housing 1 is a valve bottom 10 which is pushed by way of its upstream inlet region 11 onto an output 12 from the mixing valve.

Through the valve bottom 10 there leads a central through-passage 13, which opens into the receptacle 14 of the valve bottom 10. Inserted into this central receptacle 14 is a valve cartridge 15. At the output of the valve bottom partially surrounding the valve cartridge 15, a holding sleeve 16 is inserted into the fitting housing 1 and fixed there. The holding sleeve 16 extends as far as just before the outlet from the sanitary fitting.

In its front region facing the outlet 8, the holding sleeve 16 contains an inner receptacle 17, into which an intermediate element 18 is inserted. An outlet element 19 is inserted into the holding sleeve 16 at its end facing the outlet 8, the outlet element 19 being a jet regulator. The outlet element 19 has a partially spherical outer side, which is accommodated in a correspondingly shaped mating surface so that the outlet element 19 can be pivoted within a particular angular range.

Mounted on the holding sleeve 16 is the sleeve 9 that forms the actuating element. Said sleeve can be rotated about the holding sleeve 16 connected in a rotationally fixed manner to the sanitary fitting.

The valve cartridge 15, which forms a shut-off valve, contains, on its side facing the outlet 8, a hollow adjusting element 21 provided with an external toothing 20. When the shut-off valve is open, the water flows through the valve cartridge 15 and through the hollow adjusting element 21.

Arranged in the radial direction within the holding sleeve 16 is a rotary shaft 22 which is guided by way of its lateral surface on the inner surface of the holding sleeve 16. The rotary shaft has, in its end region facing the valve cartridge 15, an opening which is formed in a complementary manner to the outer side of the adjusting element 21. As a result, a rotation of the rotary shaft 22 results in a rotation of the adjusting element 21 of the valve cartridge 15. The rotary shaft 22 has a blind bore 23 located in the extension of the adjusting element 21, said blind bore ending at a bottom. In the region of the bottom, channels 24 lead in the radial direction out of the rotary shaft 22.

A rotation of the sleeve 9 forming the actuating element for the shut-off valve 15 results in a rotation of the rotary shaft 22, as will be shown in the following text. Depending on the position of the rotary shaft 22, as soon as the valve cartridge 15 is open, the water runs to the various outlet possibilities from the outlet 8.

Figure 3:
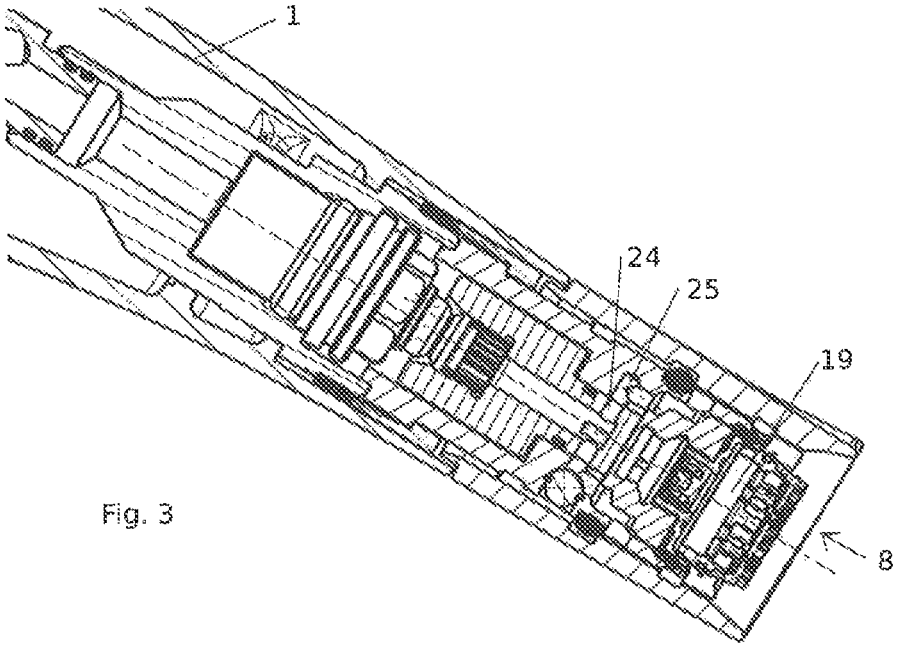
FIG. 3 shows an axial section through the fitting housing in the region of the outlet.

An example is illustrated in FIG. 3. FIG. 3 shows the outlet end from the sanitary fitting in a position in which the channels 24 are located in the section plane. In this position, the channels 24 are located in a manner corresponding to angled channels 25 in the holding sleeve 16, which open into the receptacle 17. From there, the water runs towards the outside through a narrow intermediate space between the insert 18 and the holding sleeve 16. The water thus flows past the outlet element 19, specifically on the outer side of the latter.

Figure 4:
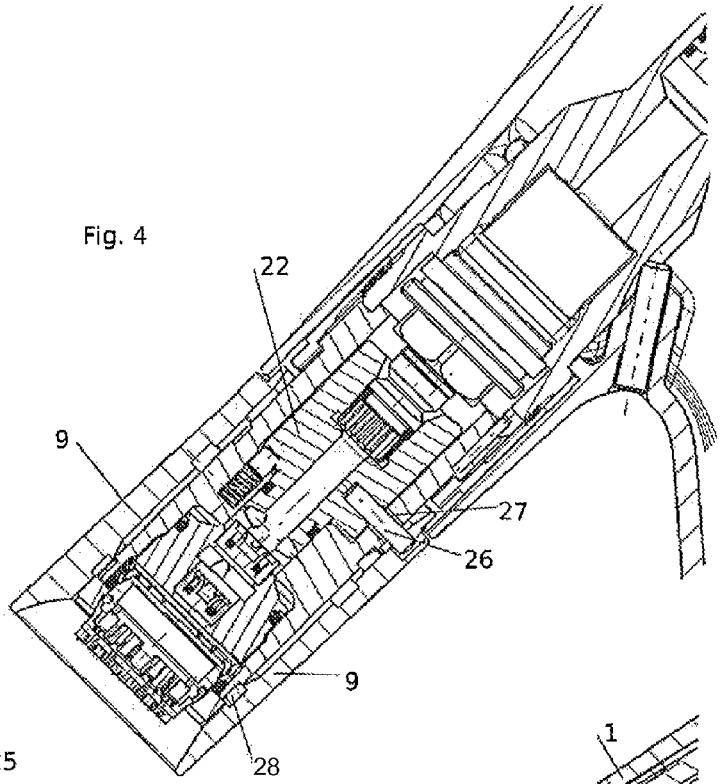
FIG. 4 shows a further axial section in the region of the outlet.

Now to FIG. 4. FIG. 4 shows that the sleeve 9 forming the actuating element has a pin 26 which engages, through a slot 27 in the holding sleeve 16, into a blind bore in the rotary shaft 22. In this way, a rotation of the sleeve 9 results in a rotation of the rotary shaft 22.

Figure 5:
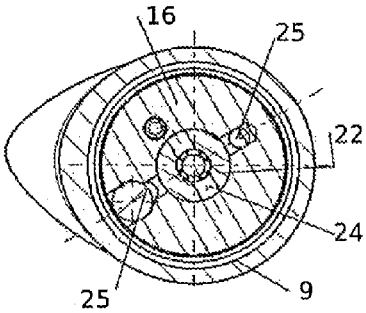
FIG. 5 shows a cross section through the arrangement in FIG. 4.
Figure 6:
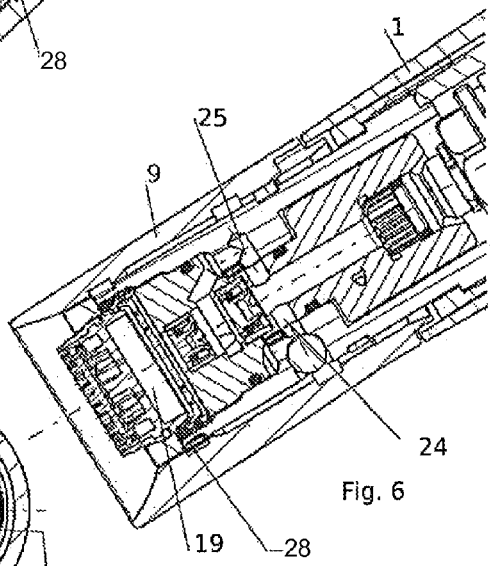
FIG. 6 shows an axial section corresponding to FIG. 4, with the change-over device adjusted.
Figure 7:
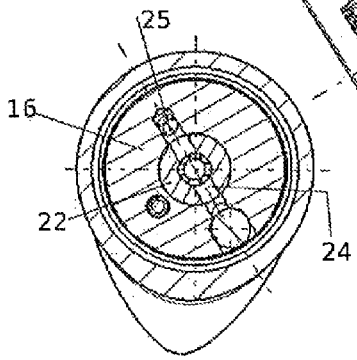
FIG. 7 shows a section corresponding to FIG. 5 through the arrangement in FIG. 6.

FIG. 5 shows a cross section through the outlet end of the sanitary fitting. The rotary shaft 22 is in a position in which the channels 24 are closed by the wall of the holding sleeve 16. The section of FIG. 5 likewise shows that the channels 25 in the holding sleeve 16 are arranged diametrically. If the rotary shaft 22 is now rotated with the aid of the sleeve 9, the position in FIGS. 6 and 7 is produced. Here, the channels 25 in the holding sleeve 16 are located in a manner corresponding to the channels 24 in the rotary shaft 22. Therefore, the water flows past the outer side of the outlet element 19.

Figure 2:
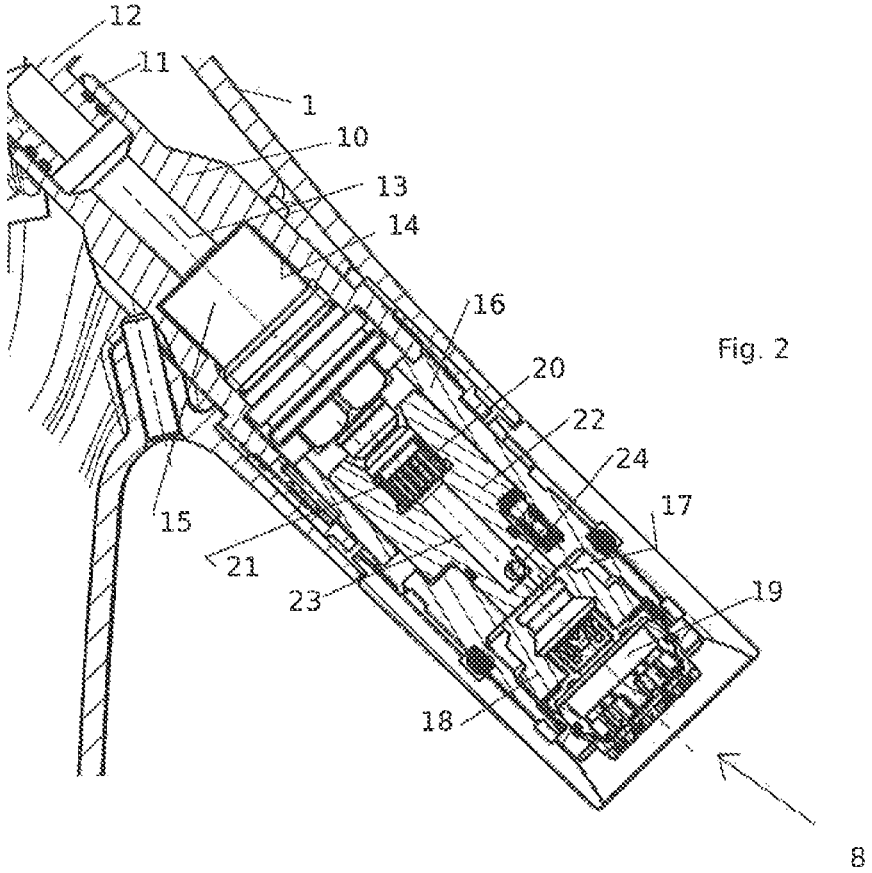
FIG. 2 shows an axial section through the fitting housing in the region of the outlet.

In the position illustrated in FIG. 2, the water flows through the outlet element 19.

Starting from the closed position of the valve cartridge 15, a rotation of the sleeve 9 first results in the valve cartridge opening and further rotation results in switching over between the outlet element 19 being acted upon by water, see the position in FIG. 2, and the channels 25 being acted upon, this resulting in water flowing past the outlet insert 19 to the jet outlet means 28.

During this rotation of the rotary shaft 22, the outlet element 19 itself is not rotated, since it is fixed to the holding sleeve 16. If the outlet element 19 has been set in an inclined position, this being possible on account of the spherical outer side, this inclined position is retained. The position of the outlet element 19 does not change upon rotation of the sleeve 9.

In the embodiment illustrated, the sleeve 9 forming the actuating element not only forms an extension of the fitting housing 1, but also has a lateral surface which is accessible for a user to act upon along the entire length and over the entire circumference of the sleeve 9. It is also conceivable for the sleeve only to be accessible at a particular location, which a user would have to take hold of in order to rotate it. What is important is that the sleeve is mounted independently of the outlet element 19.

We claim:

1. A sanitary fitting, comprising:

a fitting housing having an outlet end, an outlet out of the fitting housing at said outlet end, a shut-off valve with positions that selectively allow and block water flowing out of the sanitary fitting at said outlet end, an actuating element for the shut-off valve, an outlet element arranged in a holding sleeve that is fixedly connected to the sanitary fitting, wherein the actuating element is formed as a sleeve surrounding the outlet and configured to be grasped by a user, said sleeve configured to be grasped by the user being mounted so as to be rotatable about its own axis independently of the outlet element and being arranged outside the holding sleeve so as to radially surround the holding sleeve and to adjoin the fitting housing at said outlet end, a switch-over valve arranged downstream of the shut-off valve in a flow direction and between the shut-off valve and the outlet element, and wherein the switch-over valve is actuable by the actuating element for the shut-off valve.

2. The sanitary fitting according to claim 1, having two jet-outlet possibilities out of the outlet of the fitting housing.

3. The sanitary fitting according to claim 1, wherein the shut-off valve is formed as a straight-way valve.

4. The sanitary fitting according to claim 1, wherein the outlet element is pivotable in the fitting housing.

5. The sanitary fitting according to claim 2, further comprising a jet outlet means surrounding the outlet element.

6. The sanitary fitting according to claim 1, wherein the fitting housing is tubular at least in a region of the outlet.

7. The sanitary fitting according to claim 1, wherein the shut-off valve comprises a valve cartridge.

8. The sanitary fitting according to claim 1, wherein a lateral surface of the sleeve forming the actuating element is exposed.

9. The sanitary fitting according to claim 4, further comprising a jet outlet means surrounding the outlet element.

10. The sanitary fitting according to claim 6, wherein the actuating element extends flush with the fitting housing.

11. The sanitary fitting according to claim 7, wherein the valve cartridge is arranged in a concentric manner in a tubular part of the housing of the sanitary fitting.

* * * * *